United States Patent [19]

Akashi

[11] Patent Number: 4,571,785

[45] Date of Patent: Feb. 25, 1986

[54] SEPARABLE BOTTOM-END-STOP ASSEMBLY FOR SEPARABLE SLIDE FASTENER

[75] Inventor: Shunji Akashi, Kurobe, Japan

[73] Assignee: Yoshida Kogyo K.K., Tokyo, Japan

[21] Appl. No.: 575,863

[22] Filed: Feb. 1, 1984

[30] Foreign Application Priority Data

Feb. 2, 1983 [JP] Japan ..... 58-13834

[51] Int. Cl.[4] ..... A44B 19/00

[52] U.S. Cl. ..... 24/433; 24/434

[58] Field of Search ..... 24/433, 434

[56] References Cited

U.S. PATENT DOCUMENTS

| | | | |
|---|---|---|---|
| 2,146,691 | 2/1939 | Sundback | 24/433 |
| 3,365,758 | 1/1968 | Hansen | 24/433 |
| 4,112,553 | 9/1978 | Weitzner | 24/433 |
| 4,244,087 | 1/1981 | Akashi | 24/433 |
| 4,377,022 | 3/1983 | Akashi | 24/433 X |
| 4,414,718 | 11/1983 | Kumano | 24/434 X |

FOREIGN PATENT DOCUMENTS

| | | | |
|---|---|---|---|
| 865133 | 1/1953 | Fed. Rep. of Germany | 24/433 |
| 2115383 | 12/1971 | Fed. Rep. of Germany | 24/433 |
| 143854 | 9/1980 | Fed. Rep. of Germany | 24/433 |

*Primary Examiner*—William E. Lyddane
*Assistant Examiner*—Peter A. Aschenbrenner
*Attorney, Agent, or Firm*—Hill, Van Santen, Steadman & Simpson

[57] ABSTRACT

A separable bottom-end-stop assembly of thermoplastic synthetic resin, for a separable slide fastener, comprises a pair of first and second separate pin members, and a socket member for being secured to the first pin member, the socket member having a pair of first and second bores receptive of the first and second pin members, respectively. The first pin member has on its opposite faces a pair of recesses, and the socket member has a pair of opposed projections extending into the first bore. In assembling, the projections of the socket member are received in the respective recesses of the first pin member when the latter is inserted into the socket member's first bore. Because of this projection-and-recess locking, the first pin member can be kept exactly in position relative to the socket member while these two members are joined together by fusing.

4 Claims, 13 Drawing Figures

SEPARABLE BOTTOM-END-STOP ASSEMBLY FOR SEPARABLE SLIDE FASTENER

BACKGROUND OF THE INVENTION

1. Field of the Invention

The present invention relates to a separable bottom-end-stop assembly for a separable slide fastener.

2. Prior Art

There are known various separable slide fasteners in which a separable bottom-end-stop assembly of thermoplastic synthetic resin is mounted on adjacent bottom ends of opposed fastener stringers. The separable bottom-end-stop assembly generally comprises a pair of pin members secured to the inner tape margins at their respective bottom end portions, and a socket member secured to one of the pin members. In some of the known bottom-end-stop assemblies, the socket member is attached to one of the pin members by snap action, and in the others, the socket member is fused with one of the pin members by using an ultrasonic horn, for example.

However, in the former case, adequately firm attachment of the socket member cannot be achieved; yet, increasing the amount of "snap-action" strength causes non-easy insertion of the pin member into a bore of the socket member. The one pin member thus tends to be inclined relative to the socket member to assume an improper posture. Consequently, accurate and reliable assembling of such prior bottom-end-stop components cannot be carried out by a fully-automated assembling machine and must be done by a well-experienced person who operates various separate tools or devices, which is laborious and time-consuming.

In the latter case, although the one pin member can be inserted into the socket member's bore easily, it is difficult to place the one pin member exactly in position relative to the socket member. Therefore, this prior bottom-end-stop assembly also cannot be assembled by a fully-automated machine.

SUMMARY OF THE INVENTION

According to the present invention, a separable bottom-end-stop assembly of thermoplastic synthetic resin, for a separable slide fastener, comprises a pair of first and second separate pin members, and a socket member for being secured to the first pin member, the socket member having a pair of first and second bores receptive of the first and second pin members, respectively. The first pin member has on its opposite faces a pair of recesses, and the socket member has a pair of opposed projections extending into the first bore. In assembling, the projections of the socket member are received in the respective recesses of the first pin member when the latter is inserted into the socket member's first bore. Because of this projection-and-recess locking, the first pin member can be kept exactly in position relative to the socket member while these two members are joined together by fusing.

It is therefore an object of the invention to provide a separable bottom-end-stop assembly in which the socket member can be attached to one of the pin members easily and accurately with adequate firmness.

Another object of the invention is to provide a separable bottom-end-stop assembly which can be assembled by a fully-automated machine.

Many other advantages, features and additional objects of the present invention will become manifest to those versed in the art upon making reference to the detailed description and the accompanying drawings in which preferred embodiments incorporating the principles of the present invention are shown by way of illustrative example.

DETAILED DESCRIPTION

Figure 1:
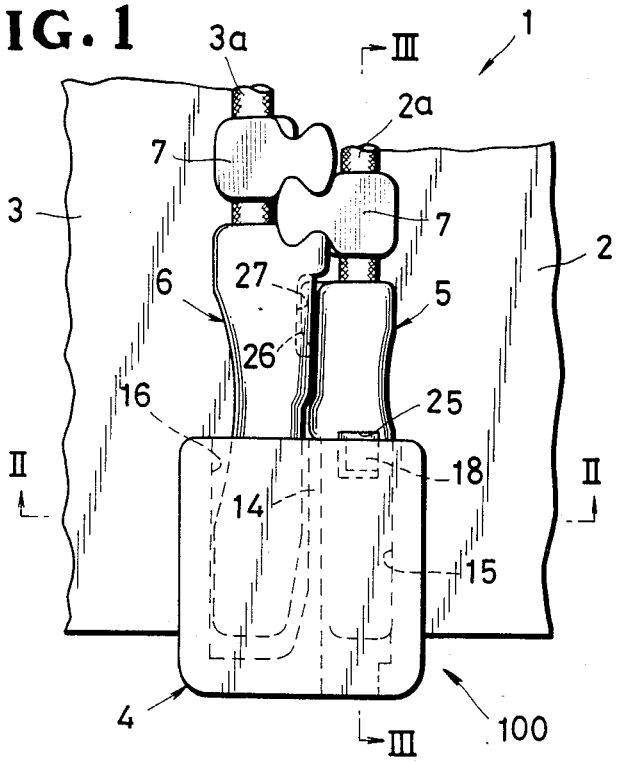
FIG. 1 is a fragmentary plan view of a separable slide fastener having a separable bottom-end-stop assembly embodying the present invention.

FIG. 1 shows a separable slide fastener 1 comprising a pair of fastener stringers each including a stringer tape 2, 3 carrying on and along its inner longitudinal margin 2*a*, 3*a* a row of coupling elements 7 in the form of separate scoops made of thermoplastic synthetic resin. A separable bottom-end-stop assembly 100 is mounted on adjacent bottom ends of the stringers at the respective bottom end portions of the confronting inner tape-margins 2*a*, 3*a*. The bottom end portion is devoid of several coupling elements 7, the number of which is not pertinent here. A slider (not shown) is threaded on the opposed rows of coupling elements 7 for movement therealong to close and open the slide fastener 1.

As shown in FIGS. 1–4, the separable bottom-end-stop assembly 100 includes a first separate pin member 5 of thermoplastic synthetic resin mounted on the bottom end portion of one of the inner tape-margins 2*a* by injection-molding, a second separate pin member 6 of thermoplastic synthetic resin mounted on the bottom end portion of the other inner tape-margin 3*a* by injection-molding, and a socket member 4 of thermoplastic synthetic resin secured to the first pin member 5 by fusing in a manner described below.

Figure 2:
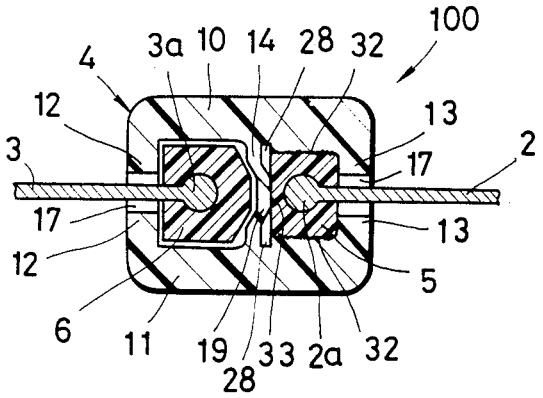
FIG. 2 is a transverse cross-sectional view taken along line II—II of FIG. 1.
Figure 4:
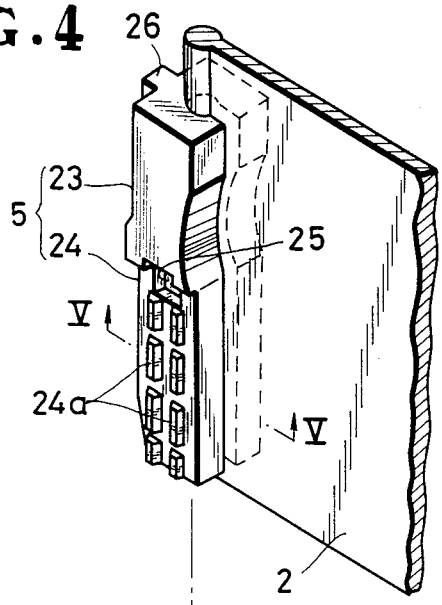
FIG. 4 is an exploded perspective view of the bottom-end-stop assembly of FIG. 1, with one of a pair of pin members omitted.

As shown in FIG. 4, the socket member 4 has a pair of flanged upper and lower wings 10, 11 joined by a partition wall 14 extending centrally of the wings 10, 11 to define a first longitudinal through-bore 15 and a second longitudinal blind bore 16 for receiving a portion of the first pin member 5 and a portion of the second pin member 6, respectively. The socket member 4 has a pair of slits 17, 17, each communicating with a respective one of the first and second bore 15, 16, for receiving the respective stringer tapes 2, 3, as shown in FIG. 2.

Figure 9:
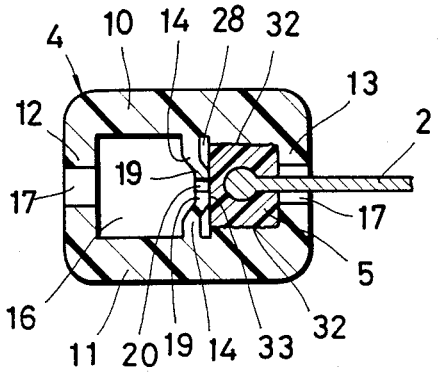
FIGS. 9 (appearing with FIG. 6) and 10 are transverse cross-sectional views similar to FIG. 2, showing modified forms of the socket member.
Figure 10:
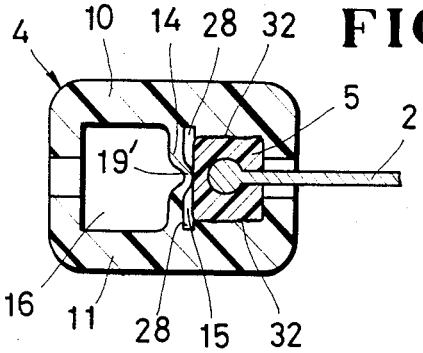

The partition wall 14 has a central bulge 19 swelling into the first bore 15 for resiliently urging or pressing the first pin member 5 against the flanges 13, 13 of the upper and lower wings 10, 11 when the first pin member 5 is inserted into the first bore 15. In an alternative form shown in FIG. 9, the partition wall 14 has in the central bulge 19 a slot 20 extending from a top end of the partition wall 14 and terminating short of a bottom end of the partition wall 14. In an another alternative form shown in FIG. 10, the central bulge 19 of the partition wall 14 has a thickness smaller than the other portions of partition wall 14.

Figure 8A:
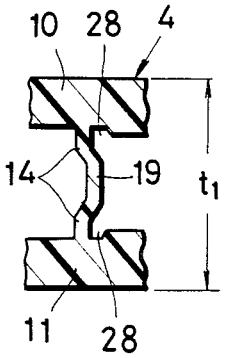
FIGS. 8A, 8B and 8C are fragmentary cross-sectional views of the socket member illustrating the manner in which the socket member is deformed while the pin member is forced into a bore of the socket member.
Figure 8B:
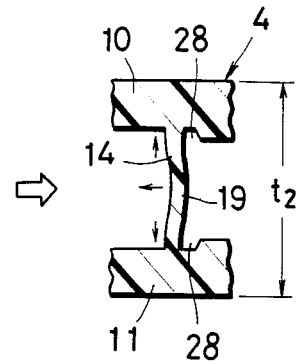
Figure 8C:
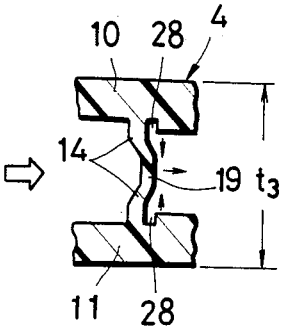

Each of the wings 10, 11 has in its inner face a groove 28 extending along the base of the partition wall 14 and opening into the first bore 15, facilitating the deforming of the partition wall 14 when the first pin member 5 is forced into the first bore 15, as described below in connection with FIGS. 8A, 8B and 8C.

The socket member 4 also has at its top end a pair of opposed projections 18, 18 extending from respective inner faces of the upper and lower wings 10, 11 into the first bore 15, for a purpose described below.

Figure 3:
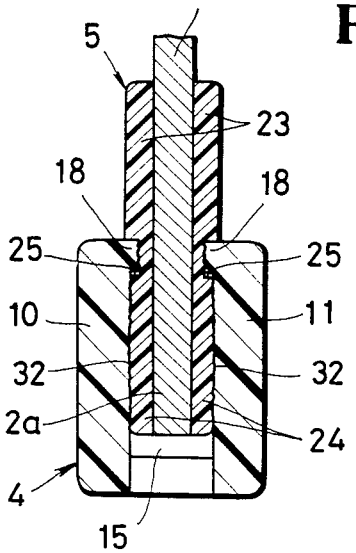
FIG. 3 is a longitudinal cross-sectional view taken along line III—III of FIG. 1.
Figure 7:
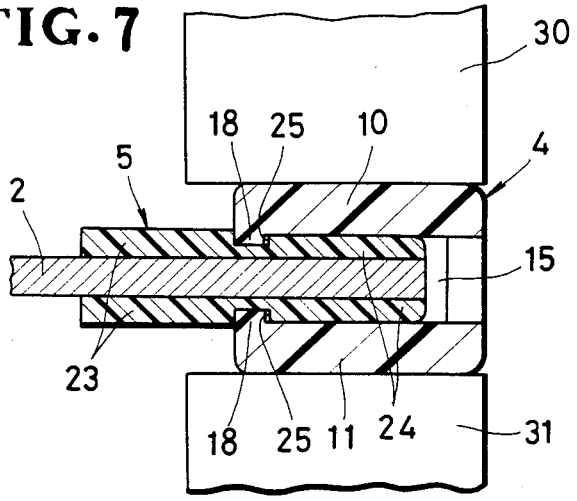
FIG. 7 is a cross-sectional view illustrating the manner in which the socket member is secured to one of the pin members by fusing.

The first pin member 5 includes an upper portion 23 and a lower portion 24 having a thickness slightly smaller than not only the thickness of the upper portion 23 but also the distance between the upper and lower wings 10, 11. When the socket member 4 is secured to the first pin member 5, the lower portion 24 of the first pin member 5 is received in the first bore 15. The first pin member 5 also has in opposite faces a pair of recesses 25, 25 for receiving the respective projections 18, 18 of the upper and lower wings 10, 11 when the socket member 4 is secured to the first pin member 5, as shown in FIGS. 1, 3 and 7. Each of the recesses 25 is disposed across to the border between the upper and lower portions 23, 24.

Figure 5:
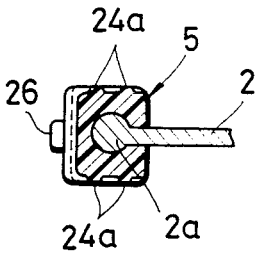
FIG. 5 is a transverse cross-sectional view taken along line V—V of FIG. 4.
Figure 5:
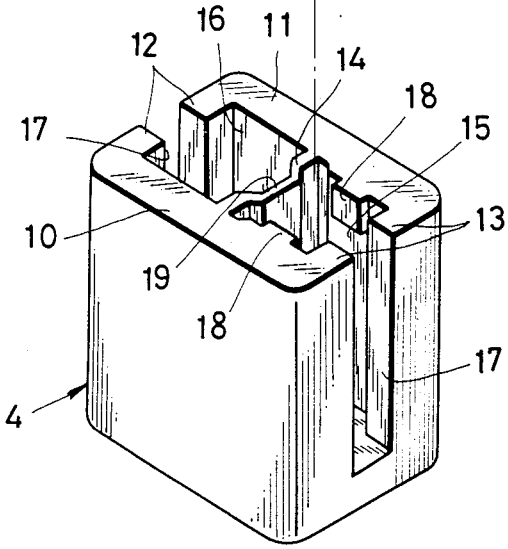

The lower portion 24 of the first pin member 5 has on its opposite faces a plurality of ridges **24*a* (FIGS. 4 and 5). The ridges 24*a* are melted and fused with the inner faces of the upper and lower wings 10, 11 when the socket member 4 and the first pin member 5 are joined together by applying heat and pressure in a manner described below in connection with FIG. 7**.

The second pin member 6 (FIG. 1) has a recess 27 for receiving a projection 26 of the first pin member 5 when the first and second pin members 5, 6 are placed exactly in position for correct interengaging of the opposed rows of coupling elements 7 of the two stringers.

Figure 6:
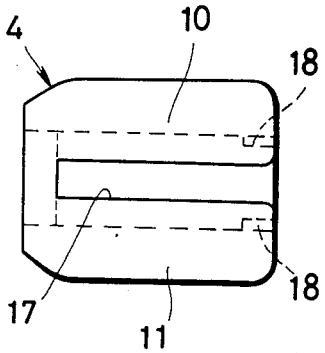
FIG. 6 is a side elevational view of a socket member of the bottom-end-stop assembly of FIG. 1.

To attach the socket member 4 to the first pin member 5, the first pin member 5 of FIG. 4 is inserted into the first bore 15 of the socket member 4 (FIGS. 4 and 6) from the top end thereof. At that time the socket member 4, which has in its free form a thickness $t_1$ (FIG. 8A), is expanded or deformed so as to have an increased thickness $t_2$ (FIG. 8B). Then the socket member 4 recovers as the projections 18, 18 of the upper and lower wings 10, 11 are received in the recesses 25, 25, respectively, of the first pin member 5.

Finally, the upper and lower wings 10, 11 are compressed between an ultrasonic horn 30 and a coacting anvil 31, as shown in FIG. 7 causing the central bulge 19 to resiliently urge or press the first pin member 5 against the flanges 13, 13 of the upper and lower wings 10, 11. As a result, the socket member 4 is integrally joined with the first pin member 5 by fusing at 32, 33 (FIGS. 2 and 3), at which time the ridges **24*a* of the first pin member 5 are melted and fused with the inner faces of the upper and lower wings 10, 11. The resultant socket member 4 has a thickness T3 (FIG. 8C**) slightly smaller than the thickness T1.

With this arrangement, the socket member 4 can be attached to the first pin member 5 easily and accurately with adequate firmness, partly because the first pin member 5 is resiliently pressed by the central bulge 19 of the partition wall 14 against the flanges 13, 13 of the upper and lower wings 10, 11, and partly because the projections 18, 18 of the wings 10, 11 are received in the respective recesses 25, 25 of the first pin member 5.

Figure 11:
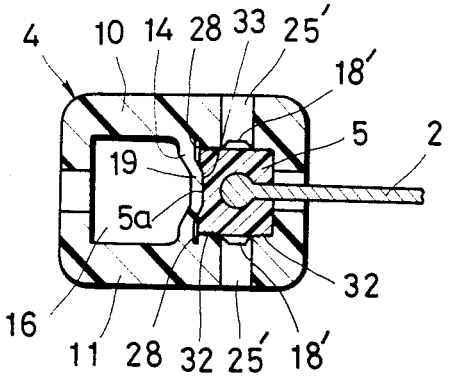
FIG. 11 is a transverse cross-sectional view showing a modification of the bottom-end-stop assembly.

In a modification shown in FIG. 11, the first pin member 5 has on its opposite faces a pair of projections 18', 18', and each of the upper and lower wings 10, 11 of the socket member 4 has an opening or recess 25' communicating with the first bore 15 for receiving a respective one of the projections 18'. The first pin member 5 also has a longitudinal groove **5*a* receptive of a portion of the partition wall's central bulge 19**.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A separable bottom-end-stop assembly for a separable slide fastener including a pair of fastener stringers, each including a stringer tape carrying on its inner longitudinal margin a row of coupling elements, the inner tape-margin having a bottom end portion devoid of coupling elements, said assembly comprising:

(a) a first pin member of thermoplastic synthetic resin adapted to be secured to the bottom end portion of the inner tape-margin of one stringer;

(b) a second pin member of thermoplastic synthetic resin adapted to be secured to the bottom end portion of the inner tape-margin of the other stringer;

(c) a socket member of thermoplastic synthetic resin secured to said first pin member and having a pair of flanged wings joined by a partition wall to define a first and a second bore between said wings, said first bore receiving a portion of said first pin member, said second bore being receptive of a portion of said second pin member, said partition wall having a central bulge swelling into said first bore to resiliently press said first pin member against said wings' flanges that partly define said first bore; and (d) one of said first pin member and said socket member having a pair of recesses, the other of said first pin member and said socket member having a pair of projections each received in a respective one of said recesses.

2. A separable slide fastener according to claim 1, said pair of recesses being disposed in opposite faces of said first pin member, each of said projections being disposed adjacent to a top end of said socket member and extending inwardly from a respective one of said wings.

3. A separable bottom-end-stop assembly according to claim 1, said pair of projections extending from opposite faces of said first pin member, each of said recesses being disposed in a respective one of said wings and opening to said first bore.

4. A separable slide fastener according to claim 1, said first pin member having a longitudinal groove receiving a portion of said partition wall's central bulge.

* * * * *